US005125374A

United States Patent [19]

Saito

[11] Patent Number: 5,125,374

[45] Date of Patent: Jun. 30, 1992

[54] VALVE ACTUATING ARRANGEMENT FOR ENGINE

[75] Inventor: Tetsushi Saito, Iwata, Japan

[73] Assignee: Yamaha Hatsudoki Kabushiki Kaisha, Iwata, Japan

[21] Appl. No.: 550,383

[22] Filed: Jul. 10, 1990

[30] Foreign Application Priority Data

Jul. 14, 1989 [JP] Japan ..... 1-181891

[51] Int. Cl.[5] ..... F01L 1/26; F01L 1/24

[52] U.S. Cl. ..... 123/90.43; 123/90.22; 123/432

[58] Field of Search ..... 123/432, 315, 90.22, 123/90.27, 90.6, 90.28, 90.65, 90.67, 90.43, 90.45, 90.46, 302, 308

[56] References Cited

U.S. PATENT DOCUMENTS

| | | | |
|---|---|---|---|
| 4,660,529 | 4/1987 | Yoshikawa | 123/432 |
| 4,877,004 | 10/1989 | Nishizawa | 123/432 |
| 4,932,377 | 6/1990 | Lyle | 123/432 |
| 5,012,783 | 5/1991 | Ferrazzi | 123/432 |
| 5,031,586 | 7/1991 | Masuda et al. | 123/90.27 |

*Primary Examiner*—E. Rollins Cross
*Assistant Examiner*—Thomas N. Moulis
*Attorney, Agent, or Firm*—Ernest A. Beutler

[57] ABSTRACT

A valve arrangement for a cylinder head assembly employing three intake valves and two exhaust valves for each cylinder. Not all of the intake valves reciprocate along parallel axes and hydraulic adjusters are operatively associated with the camshafts and rocker arms that operate the valves from the respective camshafts. The geometric relationship of the valves is chosen so as to maintain a compact and effective combustion chamber configuration and facilitate machining of the bores in which the hydraulic adjusters are positioned.

21 Claims, 6 Drawing Sheets

VALVE ACTUATING ARRANGEMENT FOR ENGINE

BACKGROUND OF THE INVENTION

This invention relates to a valve train for an engine and more particularly to an improved valve actuating system for an engine.

It has been recognized generally that the volumetric efficiency of an engine of a given displacement and bore diameter can be improved by utilizing a greater number of smaller dimension valves than a smaller number of larger dimension valves. For most practical purposes, in connection with automotive type engines, four valves per cylinder has regarded as the practical upward limit. There are a variety of reasons for this. One of the main reasons why engines have been generally limited to four valves per cylinder, even when high performance racing engines are employed, is that the incorporation of more than four valves per cylinder gives rise to certain design problems which can reduce the performance of the engine.

For example, if more than four valves per cylinder are employed with conventional arrangements, the surface area of the combustion chamber becomes quite large. This reduces performance due to excessive quenching. In addition, to provide adequate clearance, the clearance volume becomes relatively large and hence the compression ratio falls. This tends to reduce the performance. The use of more valves per cylinder than four can give rise to masking problems that can adversely effect the induction or exhaust efficiency.

Recently, it has been acknowledged that a certain specific placement of the valves and combustion chamber configuration will permit the use of five valves per cylinder and yet achieve high performance. The way this is normally done is to displace three intake valves and two exhaust valves, all at an acute angle to a plane containing the axis of the cylinder bore. The three intake valves are disposed so that two valves reciprocate along parallel axes that are at the same angle to this plane and the third valve reciprocates along an axis that is not parallel to the first and second axes and which lies at a different angle to the plane. However, such angular placement of the valves can give rise to difficulties in simplifying the actuation of the valves.

Coupled with the aforenoted problems, it is also desirable to provide in the valve actuating system a hydraulic lash adjuster so as to minimize servicing of the engine and to provide a more quiet running engine. However, coupled with the aforenoted problems, the positioning of the hydraulic lash adjusters for the engine further complicates the design.

It is, therefore a principal object of this invention to provide an improved multiple valve arrangement for an internal combustion engine that embodies hydraulic lash adjusters.

It is another object of the invention to provide a multiple valve engine having hydraulic lash adjusters in which the formation of the cylinder head can be relatively easy and at a low cost.

SUMMARY OF THE INVENTION

This invention is adapted to be embodied in a valve arrangement for an internal combustion engine that comprises a cylinder head which defines in part a combustion chamber. A pair of poppet valves are supported for reciprocation relative to the cylinder head about axes which are disposed at different acute angles to a first plane and which axes projected into a plane perpendicular to the first plane intersect at a point spaced from the heads of the poppet valves. A single camshaft is journaled for rotation about an axis parallel to the first plane and a pair of rocker arms are each associated with a camshaft and a respective one of the valves for operating the respective valve upon rotation of the camshaft. A pair of hydraulic valve adjusters are each associated with a respective one of the rocker arms for defining the pivot axis thereof and for controlling the lash between the camshaft and respective valve and rocker arm. The hydraulic adjusters operate along parallel axes that are inclined at the same acute angle to the first plane. Projections of the adjuster operating axes in the second plane lie at substantially the same angle to the first plane as the bisector of the axes of the projections of the valve axes in the second plane.

DETAILED DESCRIPTION OF THE PREFERRED EMBODIMENT OF THE INVENTION

Figure 1:
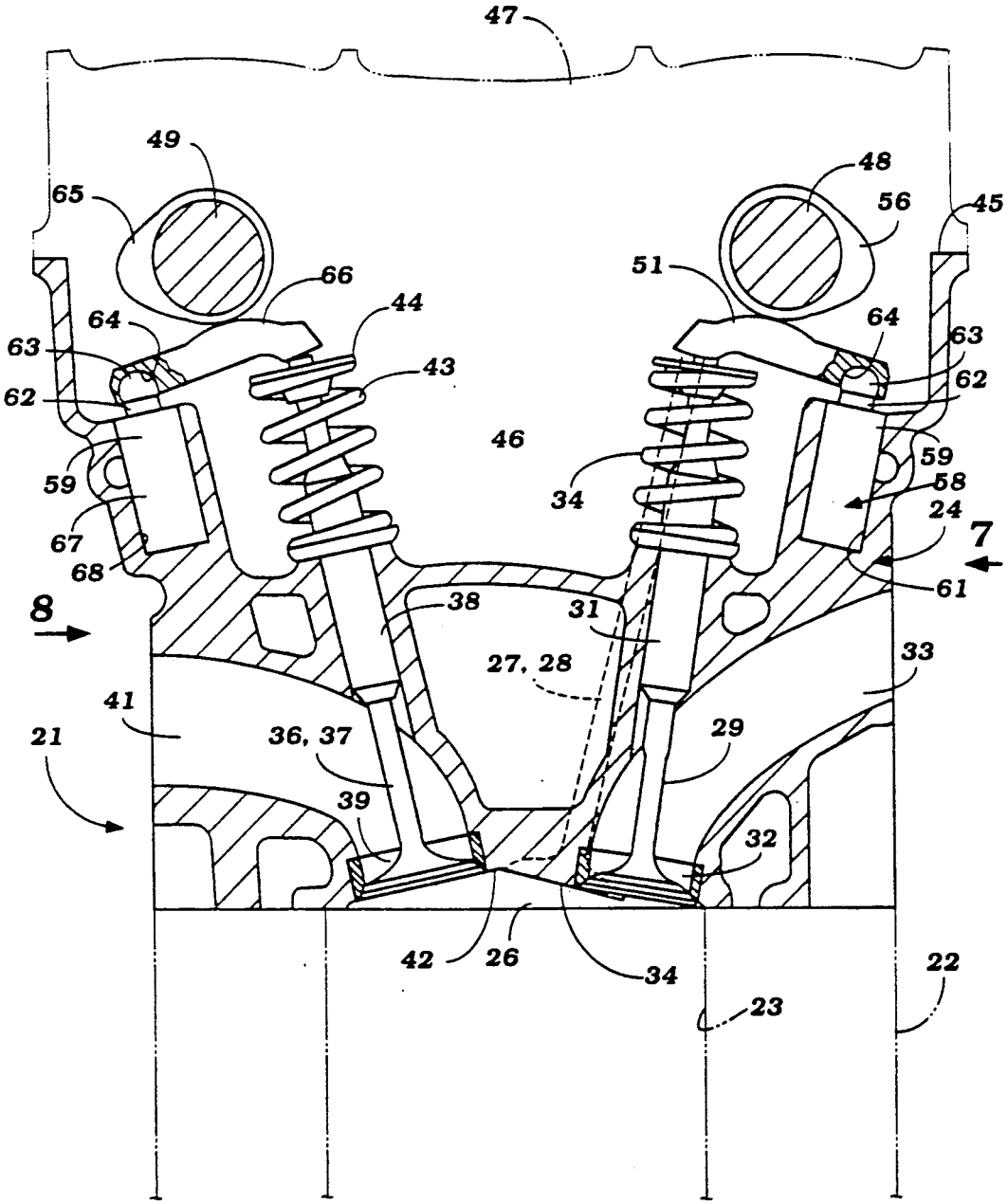
FIG. 1 is a cross sectional view taken through a single cylinder of an internal combustion engine constructed in accordance with an embodiment of the invention and wherein certain components of the engine are shown in phantom. This view is taken generally along the line 1—1 of FIG. 3.

Referring now in detail to the drawings and initially primarily to FIG. 1, a multiple cylinder internal combustion engine, constructed in accordance with an embodiment of the invention is identified generally by the reference numeral 21. The engine 21 includes a cylinder block 22 which may be conventional and hence is only shown in phantom in FIG. 1 in which a plurality of aligned bores 23 are formed. In the illustrated embodiment, the engine 21 is of the four cylinder in line type. It should be readily apparent, however, to those skilled in the art how the invention can be practiced in conjunction with engines having other numbers of cylinders and other cylinder configurations.

Since the invention deals primarily with the cylinder head assembly and more particularly to the valve actuating mechanism therefor, the details of the cylinder block, pistons and running component of the engine which may be considered to be conventional are not believed to be necessary to enable those skilled in art to practice the invention. Therefore, the cylinder head and valve train assembly therefor will now be described by particular reference to the remaining Figures in addition to FIG. 1.

A cylinder head assembly, indicated generally by the reference numeral 24 is affixed to the cylinder block 22 by means of a plurality of fasteners 25 that pass through appropriate openings in the cylinder head 24 and which are threaded into threaded openings in the cylinder block. It should be noted that the fasteners 25 are disposed so that they will be located at the four corners of the cylinder bores 23, as indicated by the broken circles in FIG. 3, to show the relationship of these fasteners 25 to the cylinder bores 23.

Figure 4:
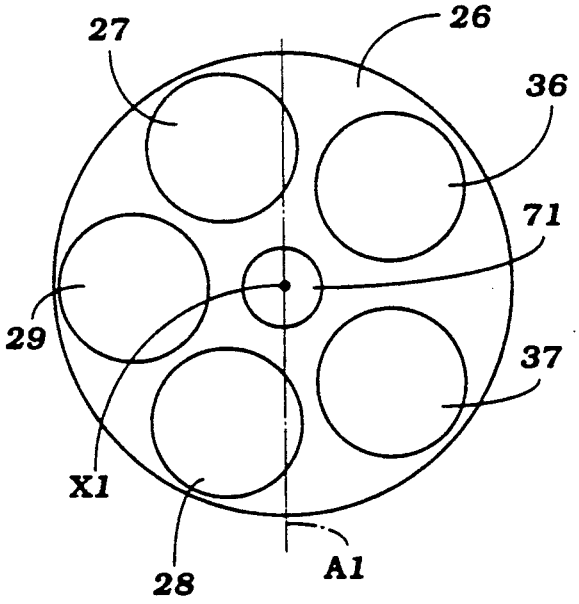
FIG. 4 is a bottom plan view of the combustion chamber.

The lower face of the cylinder head 24 is provided with a plurality of recesses 26 which have a generally pent roof configuration, as will be described. Three intake valves comprised of a pair of center intake valves 27 and 28 and a side intake valve 29 are supported for reciprocation within the cylinder head 24 by respective valve guides 31. It will be noted that the intake valves 27, 28 and 29 are oriented so that the center intake valves 27 and 28 reciprocate along axes $Y_1$ that are disposed at a relatively large acute angle $\Theta_3$ to a plane $A_1$ (FIGS. 4 and 5) containing the cylinder bore axis $X_2$ and extending parallel to the axis of rotation of the associated crankshaft.

Figure 5:
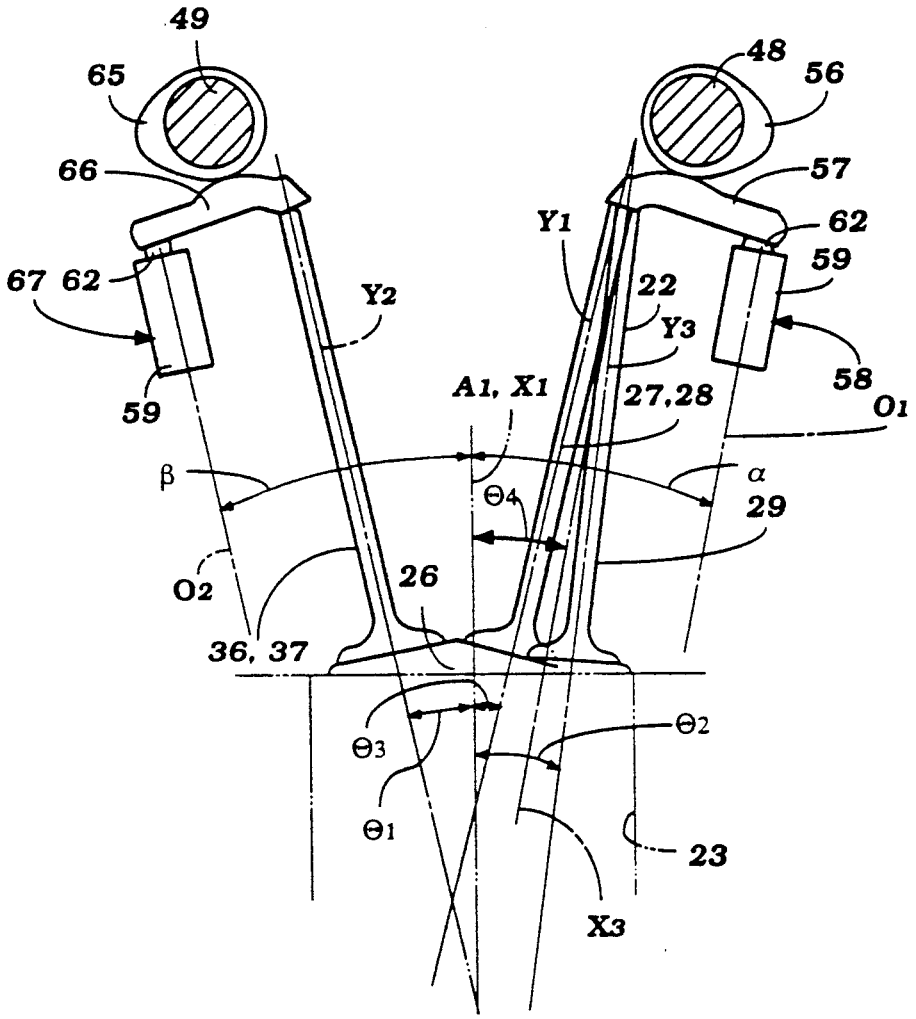
FIG. 5 is a side elevational view, looking generally in the same direction as FIG. 2, and shows the geometric relationship between the valves and the valve lifters.

The side intake valve 29 reciprocates about an axis $Y_3$ which is disposed at a lesser acute angle to this plane, this angle being indicated at $\Theta_2$ in FIG. 5. The reason for this will be described later.

Each of the intake valves 27, 28 and 29 cooperates with a respective valve seat 32 pressed into the cylinder head 24 and defining an intake port at the termination of an intake passage 33 which extends through one side of the cylinder head. The intake passages 33 may be siamese so that one intake opening in the side of the cylinder head cooperates with each of the valve seats 32 or, alternatively, separate passages may be formed for each valve seat. The orientation of the heads of the valves 27, 28 and 29 gives the lower surface of the cylinder head cavity 26 a generally inclined portion 34 which extends across the plane $A_1$ to a plane $X_2$ (FIG. 6) so that a portion of the heads of the valves 27 and 28 lies on the opposite side of the plane $A_1$ when the valves are closed, as clearly shown in FIG. 4.

Coil compression springs 34 encircle the stems of the valves 27, 28 and 29 and act against keeper retainer assemblies 35 for urging the valves 27, 28 and 29 to their closed positions. The mechanism for opening the intake valves 27, 28 and 29 will be described later.

A pair of exhaust valves 36 and 37 are supported for reciprocation on the other side of the plane $A_1$ by valve guides 38 which are pressed into the cylinder head assembly 24. The exhaust valves 36 and 37 reciprocate about respective axes $Y_2$ (FIGS. 5 and 6) which are disposed at an acute angle $\Theta_1$ to the plane $A_1$ which angle is less than the angle $\Theta_3$ and greater than the angle $\Theta_2$. The exhaust valves 36 and 37 cooperate with respective valve seats 39 (FIG. 1) that are pressed into the cylinder head 24 and which form the exhaust ports of exhaust passages 41 that extend through the side of the cylinder head 24 opposite to the intake side. As with the intake passages 33, the exhaust passages 41 may be separate or siamese. It should be noted that the disposition of the heads of the exhaust valves 36 and 37 gives rise to the combustion chamber cavity having a generally inclined surface 42 that intersects the surface 34 on the exhaust side of the plane $A_1$ at the plane $X_2$ (FIG. 6) so that this intersection is slightly offset to the side of the combustion chamber.

Coil compression springs 43 cooperate with keeper retainer assemblies 44 on the stems of the exhaust valves 36 and 37 for urging the exhaust valves 36 and 37 to their closed positions.

The mechanism for opening the intake valves 27, 28 and 29 and exhaust valves 36 and 37 against the operation of the respective springs 34 and 43 will now be described. The cylinder head 24 has an upstanding peripheral wall that defines an upwardly facing sealing surface 45 that defines in part a cavity 46 in which the valve actuating mechanism is contained. The cavity 46 is enclosed by means of a cam cover 47 that is affixed to the cylinder head 24 in a manner as will be described.

This valve actuating mechanism includes an intake camshaft 48 and an exhaust camshaft 49. The intake and exhaust camshafts 48 and 49 are journaled for rotation relative to the cylinder head 24 about parallel axes that extend generally parallel to the plane $X_1$ in a manner as described in my copending application entitled "Lubrication Arrangement For Engine", Ser. No. 07/550,384, filed Jul. 10, 1990 and assigned to the Assignee hereof. The disclosure of this application is incorporated herein by reference. Since the manner of journaling the camshafts 48 and 49 is not necessary to understand the construction and operation of this invention, this mechanism will not be described in detail.

Figure 3:
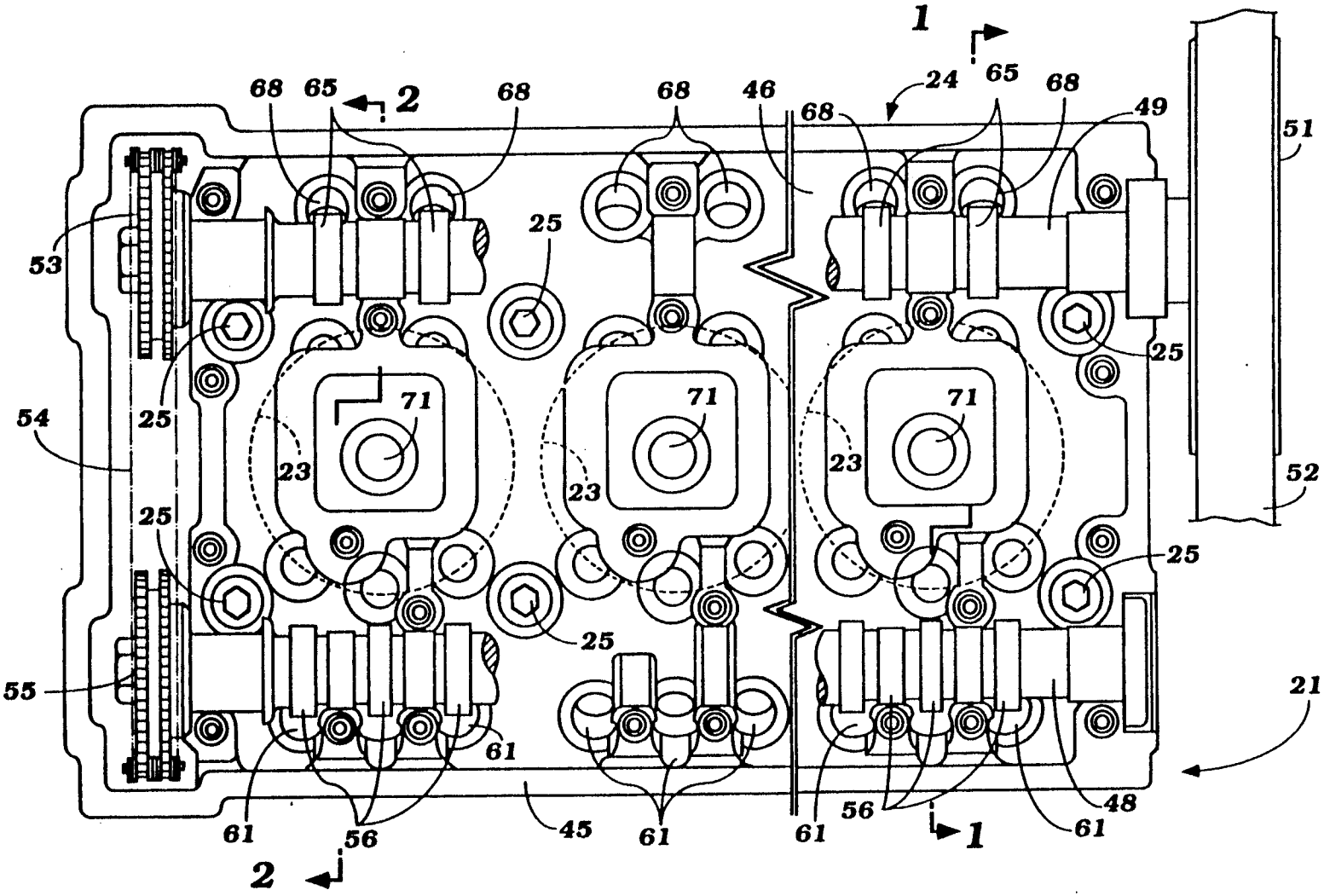
FIG. 3 is a top plan view of the cylinder head of the engine with the cam cover removed and certain portions broken away.

As may be seen in FIG. 3, one end of the exhaust camshaft 49 extends outwardly beyond the cylinder head 24 and cam cover 47 and has affixed to it a toothed pulley 51. A toothed belt 52 engages the pulley 51 and is driven by the crankshaft (not shown) at one half crankshaft speed. Affixed to the opposite end of the exhaust camshaft 49 and within the cavity 46 is a sprocket 53. A chain 54 engages the sprocket 53 and a further sprocket 55 that is affixed to the intake camshaft 48 for driving the intake camshaft.

Figure 7:
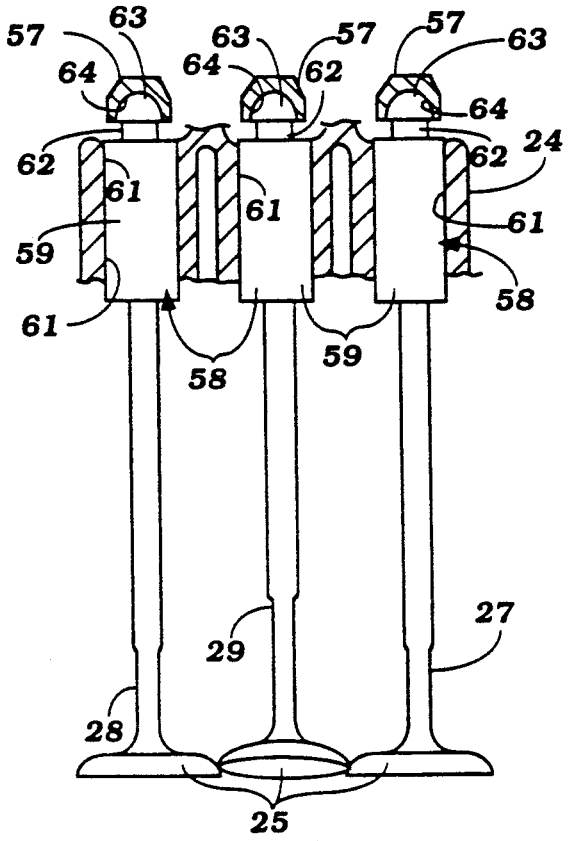
FIG. 7 is a partially schematic cross sectional view, taken generally in the direction of the arrow 7 in FIG. 1, and shows the intake valve operating systems and the relationship of the valves.
Figure 8:
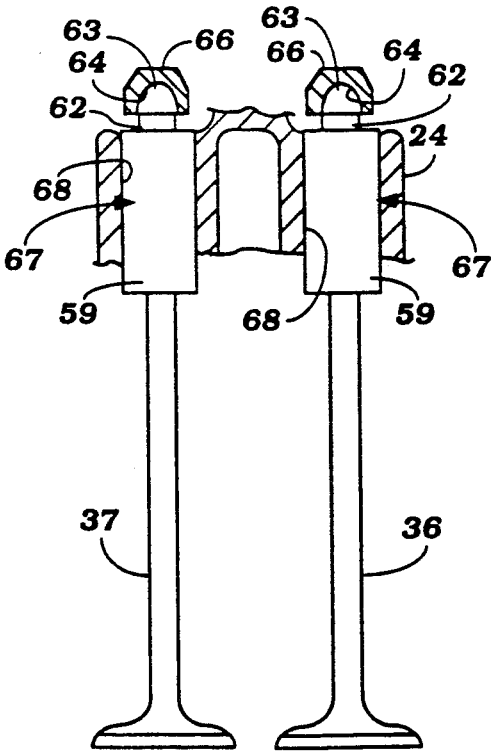
FIG. 8 is a partially schematic cross sectional view, taken generally in the direction of the arrow 8 in FIG. 1 and shows the relationship of the exhaust valves and exhaust valve operating system.

In order to operate the intake valves 27, 29 and 28, there are provided three cam lobes 56 on the intake camshaft 48 for each cylinder. Individual rocker arm assemblies 57 (FIGS. 1 and 7) have an intermediate portion that is engaged by the cam lobe 56 and an end portion that is engaged with the stem of the respective intake valve 27, 28 and 29. The rocker arms 57 are pivotally supported by means of a hydraulically operated lash adjuster, indicated generally by the reference numeral 58 and having a construction as described in my aforenoted copending application Ser. No. 07/550,384.

The hydraulic lash adjusters 58, as aforenoted, have a construction as described in my copending application. Basically, the adjusters 58 include an outer body member 59 that is received within a respective bore 61 formed in the cylinder head 24. Slidably supported within this body 59 and urged outwardly relative to it is a tappet member 62 having a spherical headed portion 63 that is received within a complementary recess 64 of the respective rocker arm 57. The bores 61 are oriented in a manner as will be described so as to insure that the cylinder head assembly 24 may be easily machined and also so that the area of contact between the rocker arms 57, tips of the valves 27, 28 and 29 and lash adjuster portions 63 will be substantially uniform, even though the valves 27, 28 and 29 are disposed at different angles.

The exhaust camshaft 49 is provided with pairs of cam lobes 65 to operate the exhaust valves 36 and 37. These cam lobes 65 cooperate with intermediate portions of exhaust rocker arms 66 which have one end portion engaged with the stems of the valves 36 and 37 for operating them. The opposite ends of the rocker arms 66 cooperate with hydraulic lash adjusters 67 which have an internal construction the same as those associated with the intake valves (lash adjusters 58). For this reason, the description of the exhaust lash adjusters 67 is not believed to be necessary.

However, these adjusters 67 have their body portions 59 received in bores 68 configured as will be described and which have their tappets 62 formed with spherical portions 63 cooperating with spherical recesses 64 found in the rocker arms 66.

The hydraulic valve adjusters 58 and 67 are supplied with lubricant under pressure, preferably in a manner described in my aforenoted copending application Ser. No. 07/550,384 and the camshafts 48 and 49 are lubricated in a manner as described therein. However, it is to be understood that other types of oil supply and lubricating arrangements may be employed It should be readily apparent that it is desirable to insure that the cylinder head assembly can be conveniently machined. Because of the different angular positions of the intake valves 27, 28 and 29 and exhaust valves 36 and 37, this presents certain difficulties. Also, as aforenoted, it is desirable to insure that the angular relationship of the rocker arms 57 and 66 and their relationships to the stems of the valves and the tappets 62 and 63 of the lash adjusters 58 and 59 operate through the same general relationship. Because of the construction, now to be described, this can be achieved.

It should be noted that the bores 61, in which the intake adjusters 58 are slidably supported, all have parallel axes that are disposed at an angle $\alpha$ to the plane $A_1$ with the line of actions of the adjusters 58 being indicated by the line $0_1$ in FIG. 5. This angle $\alpha$ is disposed so that it is substantially equal to the angle $0_4$ of a bisector line $X_3$ of projections of the axes $Y_1$ and $Y_3$ of reciprocation of the intake valves 27, 28 and 29 in a plane perpendicular to the plane $A_1$ (the plane of FIG. 5). Because of this relationship, the bores 61 may all be disposed at the same angle. This will achieve the desired result. In order to facilitate the machining process, the bores 68 in which the exhaust valve lash adjusters 67 operate along a line of action $0_3$ as shown in FIG. 5 also lie at an angle $\beta$ to the plane $A_1$ which is substantially equal to the angle $\alpha$. This greatly facilitates machining. The angle $\beta$ is also substantially equal to the angle $0_1$ along which the exhaust valves 36 and 37 reciprocate so as to further facilitate the machining.

Figure 6:
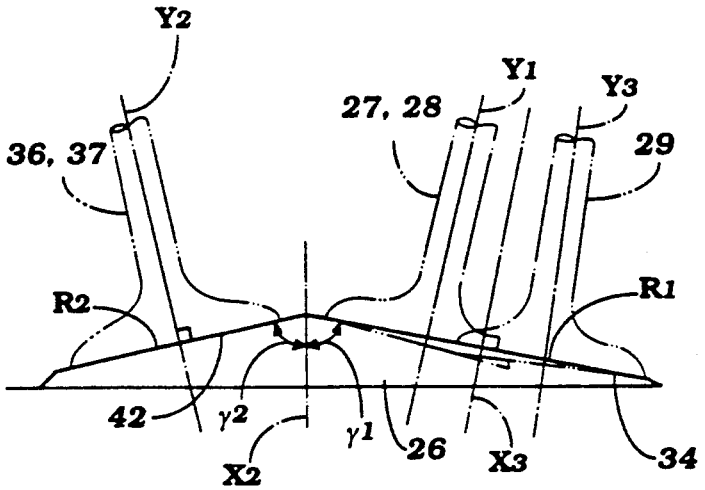
FIG. 6 is a further enlarged view, in part similar to FIG. 5, and shows the configuration of the combustion chamber.

It has already been noted that the intake valves 27, 28 and 29 have their heads lying substantially on a plane 34 that intersects a plane 42 defined by the heads of the exhaust valves 36 and 37 and that these planes intersect along the plane $X_2$ as shown in FIG. 6. In order to provide an optimum combustion chamber configuration, this configuration results in a combustion chamber 26 that is generally the shape of an isosceles triangle. That is, the angle between the plane $X_2$ and the surfaces 34, $\gamma_1$ is substantially equal to the angle $\gamma_2$ between the surface 42 and the plane $X_2$. This provides a combustion chamber that permits a high compression ratio and still achieves the ease of placement of the valves and tappets and the operation therefor.

Figure 2:
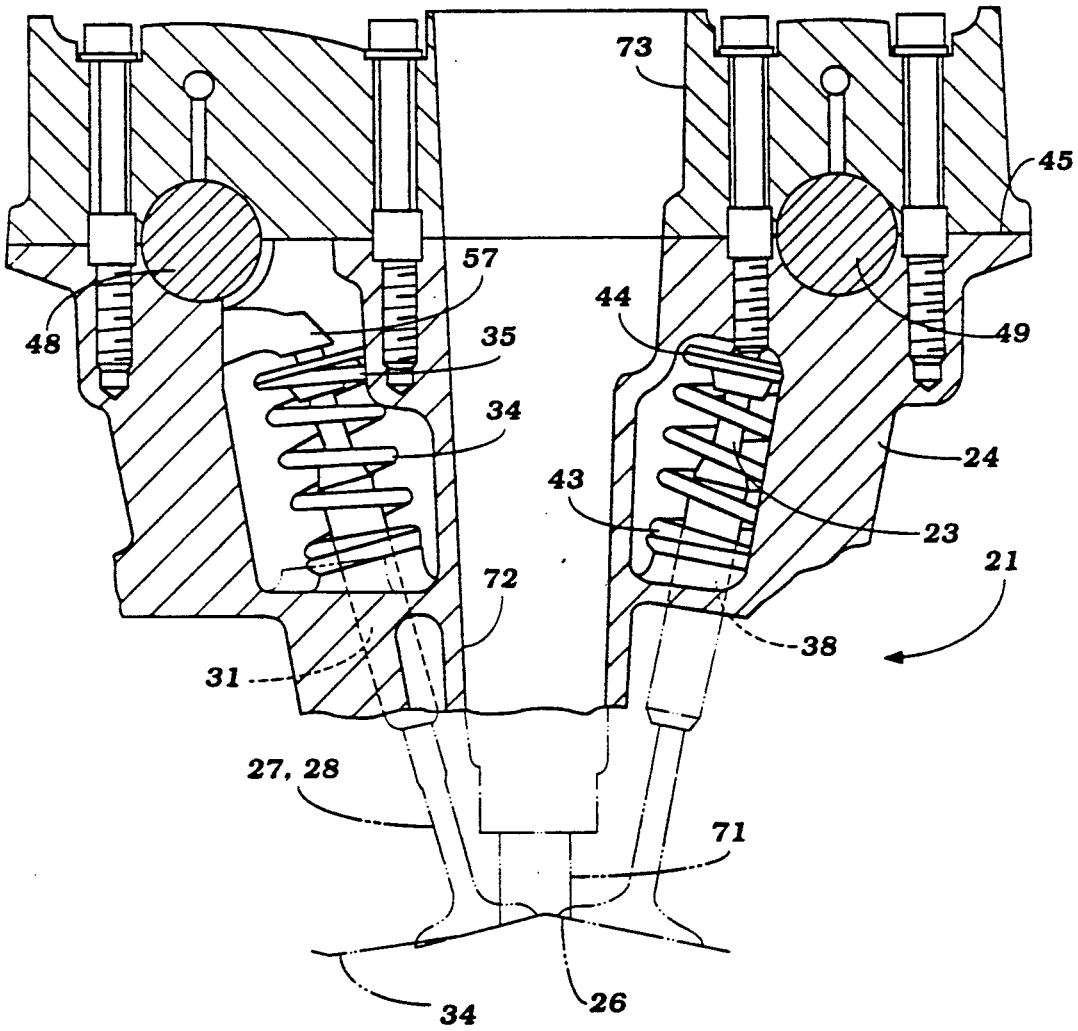
FIG. 2 is a partial cross sectional view taken along the line 2—2 of FIG. 3.

Each combustion chamber of the engine is provided with a single spark plug for firing the charge therein. The cylinder head 24 is provided with a tapped opening 71 for receiving the spark plug. This tapped opening is formed at the base of the larger opening 72. The cam cover has an even larger opening 73 for accessing these spark plugs. This construction appears best in FIG. 2.

It should be readily apparent from the foregoing description that the described construction and orientation of the valves and valve lifters permits a very easily machined construction and one which results in a substantially optimum combustion chamber configuration considering all factors. In the illustrated embodiment, the rocker arms are pivotally supported at one end by the hydraulic lash adjusters and the cam lobes cooperate with the intermediate portion of the rocker arms. Of course, a reverse relationship can also be practiced wherein the camshaft operates at the end of the rocker arm and the hydraulic adjuster is interposed at the center of the arm. Various other arrangements are also possible within the spirit and scope of the invention, as defined by the appended claims.

I claim:

1. A valve arrangement for an internal combustion engine comprising a cylinder head defining in part a combustion chamber, a pair of poppet valves supported for reciprocation relative to said cylinder head about axes which are disposed at different acute angles to a first plane and which axes projected into a second plane perpendicular to said first plane intersect at a point spaced from the heads of said poppet valves, a single camshaft journaled for rotation about an axis parallel to said first plane, a pair of rocker arms, each associated with said camshaft and a respective one of said valves for operating the respective valve upon rotation of said camshaft, a pair of hydraulic valve adjusters, each associated with a respective one of said rocker arms for defining the pivot point therefor and for controlling the lash between said camshaft and respective valve and rocker arms, said hydraulic adjusters operating along parallel axes each inclined at the same acute angle to said first plane, projections of said adjuster operating axes in said second plane lying on an acute angle which lies within a range of acute angles defined by the axes of the projections of said valves axes in said second plane.

2. A valve arrangement as set forth in claim 1 wherein the hydraulic adjusters are supported by the cylinder head.

3. A valve arrangement as set forth in claim 2 wherein the hydraulic adjusters are received in respective bores formed in the cylinder head.

4. A valve arrangement as set forth in claim 3 wherein the camshaft has cam lobes that engage the rocker arms between their point of pivotal support and their point of contact with the valves.

5. A valve arrangement as set forth in claim 1 further including a third valve supported for reciprocation by the cylinder head about an axis disposed at the same acute angle to the first plane as one of the pair of valves and which axis projected into a plane perpendicular to the first plane is coincident with the projection of the one valve of the pair in the plane and wherein the third valve is operated by a rocker arm and a hydraulic adjuster with the axis of operation of the hydraulic adjuster for the third valve being inclined at the same acute angle to the first plane as the axis of operation of the pair of hydraulic adjusters.

6. A valve arrangement as set forth in claim 5 wherein the hydraulic adjusters are supported by the cylinder head.

7. A valve arrangement as set forth in claim 6 wherein the hydraulic adjusters are received in respective bores formed in the cylinder head.

8. A valve arrangement as set forth in claim 7 wherein the camshaft has cam lobes that engage the rocker arms between their point of pivotal support and their point of contact with the valves.

9. A valve arrangement as set forth in claim 1 wherein the projection of the adjuster operating axes in the second plane lies on an acute angle which is at the same angle to the first plane as the bisector of the axes of the projections of the valve axes in the second plane.

10. A valve arrangement as set forth in claim 9 further including a second pair of valves supported for reciprocation relative to the cylinder head about parallel acute angles to the first plane on the opposite side thereof from the first pair of valves and operated by a second camshaft and a second pair of rocker arms and second pair of hydraulic adjusters.

11. A valve arrangement as set forth in claim 10 wherein the reciprocal axes of the second pair of valves are parallel to each other.

12. A valve arrangement as set forth in claim 11 wherein the acute angle of the second pair of axes is approximately equal to the acute angle of the bisector of the axes of the first pair to the plane on the opposite side thereof.

13. A valve arrangement as set forth in claim 12 wherein the line of action of the hydraulic adjusters associated with the rocker arms of the second pair of valves lies at substantially the same acute angle to the first plane as the line of operation of the first pair of adjusters.

14. A valve arrangement as set forth in claim 10 wherein all of the hydraulic adjusters are supported by the cylinder head.

15. A valve arrangement as set forth in claim 14 wherein the hydraulic adjusters are received in respective bores formed in the cylinder head.

16. A valve arrangement as set forth in claim 15 wherein each camshaft has cam lobes that engage the respective rocker arms between their point of pivotal support and their point of contact with the valves.

17. A valve arrangement as set forth in claim 10 further including a third valve supported for reciprocation by the cylinder head about an axis disposed at the same acute angle to the first plane as one of the first pair of valves and which axis projected into a plane perpendicular to the first plane is coincident with the projection of the one valve of the pair in the plane and wherein the third valve is operated by a rocker arm and a hydraulic adjuster with the axis of operation of the hydraulic adjuster for the third valve being inclined at the same acute angle to the first plane.

18. A valve arrangement as set forth in claim 17 wherein all of the hydraulic adjusters are supported by the cylinder head.

19. A valve arrangement as set forth in claim 18 wherein all the hydraulic adjusters are received in respective bores formed in the cylinder head.

20. A valve arrangement as set forth in claim 19 wherein the camshafts each have cam lobes that engage the respective rocker arms between their point of pivotal support and their point of contact with the valves.

21. A valve arrangement as set forth in claim 20 wherein the line of action of the hydraulic adjusters associated with the rocker arms of the second pair of valves lies at substantially the same acute angle to the first plane as the line of operation of the first pair of adjusters.

* * * * *